United States Patent [19]

Jensen

[11] 4,016,834

[45] Apr. 12, 1977

[54] BOILER WITH CONDENSER

[75] Inventor: Poul Wilfred Jensen, Hornbaek, Denmark

[73] Assignee: AGA Radiator AB, Helsingborg, Sweden

[22] Filed: Sept. 22, 1975

[21] Appl. No.: 615,510

[30] Foreign Application Priority Data

Sept. 27, 1974 Sweden ..... 7412220

[52] U.S. Cl. ..... 122/264; 237/60; 122/316

[51] Int. Cl.[2] ..... F22B 15/00; F22B 23/02

[58] Field of Search ..... 237/60, 63; 122/264, 122/316, 367 R, 367 C, 406

[56] References Cited

UNITED STATES PATENTS

| | | | |
|---|---|---|---|
| 840,235 | 1/1907 | McGuire | 237/60 |
| 899,314 | 9/1908 | Meres | 122/316 |
| 1,728,017 | 9/1929 | Szarka | 122/316 |
| 2,707,593 | 5/1955 | Woodcock | 237/60 |
| 2,738,928 | 3/1956 | Lieberman | 237/60 |

FOREIGN PATENTS OR APPLICATIONS

| | | | |
|---|---|---|---|
| 267,511 | 6/1928 | United Kingdom | 237/60 |

*Primary Examiner*—Kenneth W. Sprague
*Attorney, Agent, or Firm*—Larson, Taylor and Hinds

[57] ABSTRACT

An arrangement for heating a liquid including a boiler, and a condenser located at least in part within the boiler and open at its inlet end which is located within the boiler such that the liquid/gas combination heated in the boiler passes directly into the open inlet of the condenser. The condenser and the boiler may be formed as concentric tubes, the inner tube forming the condenser and the space between the tubes forming the boiler. Valves or the like are provided for determining the direction of fluid flow.

19 Claims, 4 Drawing Figures

BOILER WITH CONDENSER

The present invention relates to an arrangement in a boiler intended for heating parts of a liquid, liquid mixture or liquid suspension to boiling, whereby a condenser is connected to the boiler for the condensation of the liquid vaporized during the boiling process.

The boiler and the condenser connected thereto may be included in a circulation system for the liquid, which system comprises at least one flow-directing member, such as a one way valve. The circulation system may further comprise one or more radiators, convectors or other heaters for delivering thermic energy to one or more consumption points. However, the invention is adaptable for use in many different fields and shall not be considered to be limited to only the above mentioned special field of application.

Figure 1:
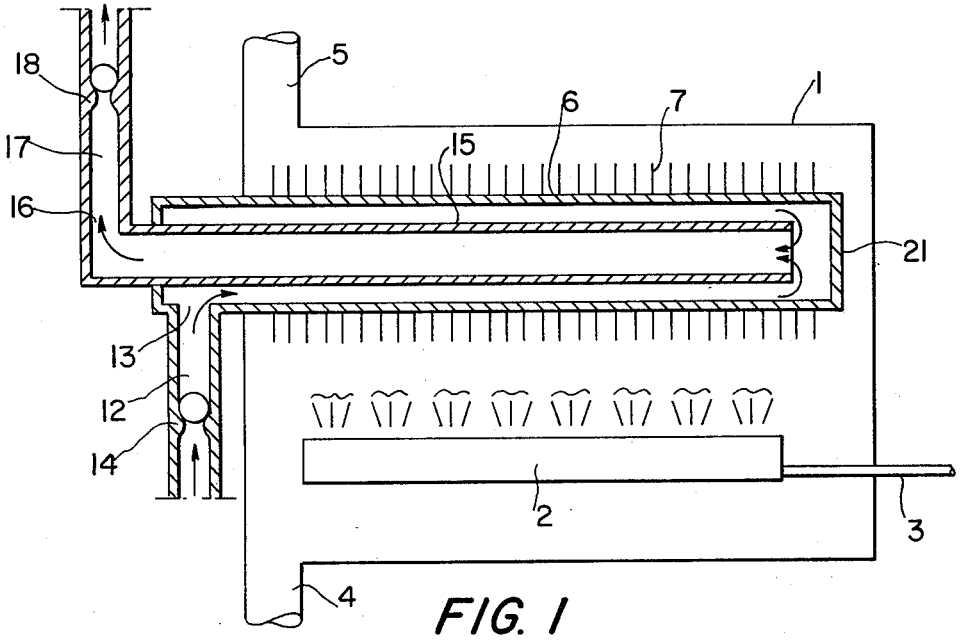
Figure 2A:
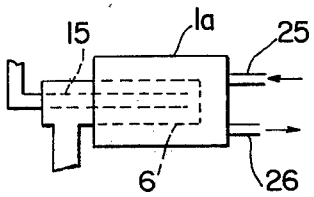
Figure 2:
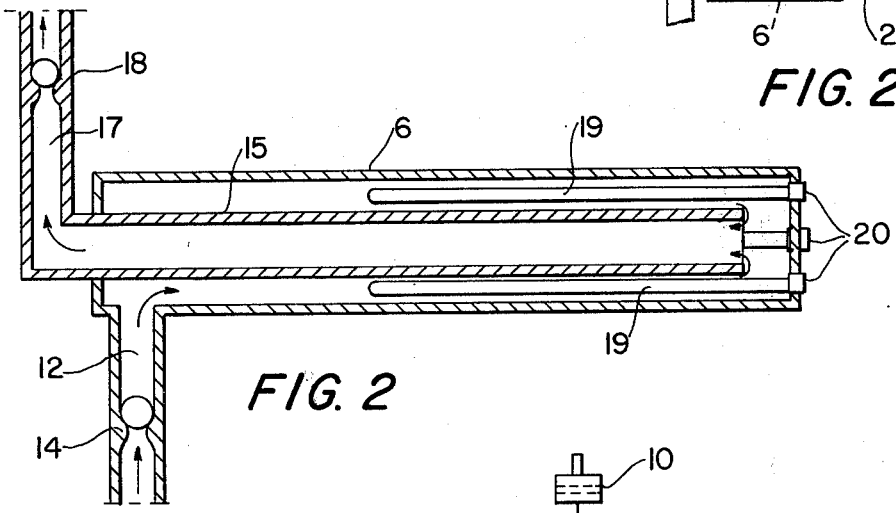
Figure 3:
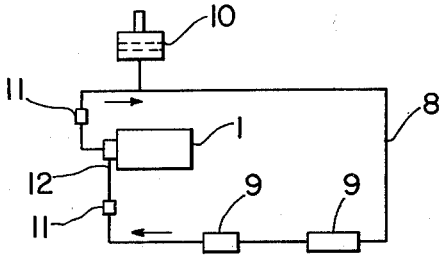

The invention is described in detail below with reference to the attached drawings, where FIGS. 1, 2 and 2*a* show three embodiments of the invention and FIG. 3 is a schematic drawing of a system showing an example of a field of application of an arrangement made according to the invention.

The device shown in FIG. 1 is intended for the heating of a liquid, liquid mixture or liquid suspension, said suspension containing small solid particles which constitute condensation cores. The device is arranged in such a way that this liquid has to flow in a certain direction. Within a casing 1 of any suitable shape, for instance rectangular, a burner 2 is arranged, to which fuel is supplied by means of a conduit 3. The air necessary for the combustion is supplied via a tube 4, and the waste gases may depart via an air exhaust tube 5. The burner 2 heats a boiler arranged in the casing 1, said boiler comprising a tube 6 which in the embodiment shown is provided with surface-enlarging means, such as fins 7 to increase the heat absorption of the tube 6.

The arrangement according to FIG. 1 may be contained in a heating system of the kind which is schematically shown in FIG. 3. This heating system comprises a closed circuit 8, in which are included one or more heat emitters 9, for instance radiators. Furthermore, the system may comprise an expansion vessel 10, adjacent to which at least one flow-directing member 11 such as a non-return valve may be provided so that flow of the liquid occurring in the system will be in the direction of the arrows shown in FIG. 3.

From said circulation system 8 the fluid is supplied to the tube 6 via a conduit 12 and through an inlet opening 13 arranged at the one of the tube 6. In the conduit 12 there is provided a flow-directing member in the form of a non-return valve 14.

The tube 6, which at its end opposite to the inlet opening 13 is closed by means of a plate 21, encloses a second tube 15, which is arranged to funtion as a condenser. The tube 15 is provided with an outlet opening 16, which leads to an outlet conduit 17, which contains another non-return valve 18. The end of the tube 15 opposite to the outlet opening 16 is opened, and hence in open communication with the space between the tubes 6 and 15.

When the liquid in the boilder is heated by means of the burner 2 steam bubbles will be created in the space between the tubes 6 and 15. Since a liquid and steam combination takes up a greater volume than liquid alone, an increase of volume takes place and as a result thereof the liquid and steam combination is pushed into the tube 15 since the non-return valve 14 prevents flow in the opposite direction. Thereby the liquid which is in the conduit 17 is pushed past the non-return valve 18. In the tube 15, which serves as condenser, the steam bubbles are condensed and the volume is decreased. This decrease of volume causes the liquid to be sucked in through the conduit 12, since the non-return valve 18 in the conduit 17 prevents flow of liquid in the opposite direction. At the same time the steam bubbles emit their vaporization heat to the liquid in the tube 15. Thereafter, new steam bubbles are created in the space between the tubes 6 and 15, whereafter the process, just described, is repeated. The result hereof is that the liquid in the system on one hand is heated and on the other hand is caused to flow in the direction of the arrows shown.

With the embodiment of the invention described, with a boiler enclosing the condenser, a very favorable relationship is achieved between the heat absorbing outer envelope surface of the boiler and the quantity of liquid flowing in the boiler, since the liquid in the boiler is mainly in the space between the tubes 6 and 15, and this space may be small because the outer diameter of the tube 15 is not substantially smaller than the inner diameter of the tube 6. The efficiency of the boiler will thus be very high.

Since, as described above, the space between the tubes 6 and 15 is small, and at the same time the inner area of the tube 15 is comparatively large, the result is that the flow speed of the liquid in the tube 15, which serves as condenser is considerably lower than the flow speed of the liquid in the space between the tubes 6 and 15. As a consequence thereof, the condensation becomes complete, so that the risk is small that steam bubbles will be present in the liquid passing out through the conduit 17.

A further advantage of the boiler and the condenser of the invention is that creation of large steam bubbles in the boiler is prevented. When such large steam bubbles are condensed in a condenser connected to the boiler, loud cracking noises will likely occur, which under certain circumstances may be very disturbing. In the arrangement of the present invention, on the contrary, only comparatively small steam bubbles are formed, and they condense practically inaudibly. Due to the fact that the boiler encloses the condenser, a further sound damping is achieved.

In the embodiment of the invention shown in FIG. 1 a burner 2 has been used to heat the boiler. It is, however, not critical to the invention how the necessary heat energy is supplied to the boiler, and as an example of other heating alternatives may be mentioned electric heating of the liquid in the boiler, heating by means of hot water from for instance a district heating plant or the like.

FIG. 2 shows an example of electric heating of the liquid boiler. As in the arrangement according to FIG. 1 the boiler 6 encloses the condenser 15. In this case a number of, for instance four electric immersion heater 19 are inserted in the space between the tubes 6 and 15. These may be assumed to be mounted in the closed plate 21 of the tube 6 and the electric current may be supplied through conduits 20. For the remaining elements of FIG. 2, the arrangement according to FIG. 2 contains inlet and outlet conduits 12 and 17 and non-return valves 14 and 18 like in the arrangement according to FIG. 1. FIG. 2*a* is similar to FIG. 1 but shows a casing 1*a* for circulating hot water into the space surrounding the boiler via inlet and outlet nozzles 25 and 26.

Although the invention has been described in considerable detail with respect to preferred embodiments, it will be understood that the invention is capable of numerous modifications and variations apparent to those skilled in the art.

I claim:

1. An arrangement for the heating of a liquid, a liquid mixture or a liquid suspension to boiling and for the condensation of steam created during the boiling, comprising:

a heating means, a boiler arranged to receive heat from the heating means, said boiler having an inlet opening, a condenser having an inlet and an outlet, said condenser inlet being located in the boiler and in open communication with the interior of the boiler such that fluid entering the boiler inlet flows at least part of the way through the boiler before entering the condenser inlet, and including flow directing means for directing the fluid in the direction from the boiler inlet through the boiler and into and through the condenser, and wherein the condenser comprises an inner tube, said inner tube being surrounded by an outer tube, the space between these tubes forming the boiler.

2. An arrangement according to claim 1, said flow directing means comprising a non-return valve located adjacent at least one of said boiler inlet or condenser outlet.

3. An arrangement according to claim 2, said non-return valve being located at both said boiler inlet and said condenser outlet.

4. An arrangement according to claim 1, said heating means comprising a fuel burner.

5. An arrangement according to claim 1, said heating means comprising electric heating elements located within the boiler.

6. An arrangement according to claim 1, said heating means comprising means for circulating hot water in the vicinity of the boiler.

7. An arrangement according to claim 1, wherein the outer tube at one end has an opening forming the said boiler inlet opening for receiving the liquid to be heated, said outer tube being closed at its other end, the inner tube having an opening at one end which forms the condenser outlet for the heated liquid and the other end of the condenser constituting the condenser inlet and being in open communication with the said space between the outer tube and the inner tube.

8. An arrangement according to claim 1, wherein the outside of the outer tube is provided with surface-enlarging means.

9. An arrangement according to claim 1, wherein the cross-sectional area of the space between the outer and the inner tube is smaller than the cross-sectional area of the inner tube.

10. An arrangement according to claim 1, wherein the inner tube is concentric with the outer tube.

11. An arrangement for the heating of a liquid, a liquid mixture or a liquid suspension to boiling and for the condensation of steam created during the boiling, comprising:

a heating means, a boiler arranged to receive heat from the heating means, said boiler having an inlet opening, a condenser having an inlet and an outlet, said condenser being located substantially completely within the boiler and in open communication with the interior of the boiler, and flow directing means including a first non-return valve being located at said boiler inlet and a second non-return valve being located at said condenser outlet for directing the fluid in the direction from the boiler inlet through the boiler and into and through the condenser.

12. An arrangement according to claim 11, said heating means comprising a fuel burner.

13. An arrangement according to claim 11, said heating means comprising electric heating elements located within the boiler.

14. An arrangement according to claim 11, said heating means comprising means for circulating hot water in the vicinity of the boiler.

15. An arrangement according to claim 11, wherein the condenser comprises an inner tube, said inner tube being surrounded by an outer tube, the space between these tubes forming the boiler.

16. An arrangement according to claim 15, wherein the outer tube at one end has an opening forming the said boiler inlet opening for receiving the liquid to be heated, said outer tube being closed at its other end, the inner tube having an opening at one end which forms the condenser outlet for the heated liquid and the other end of the condenser constituting the condenser inlet and being in open communication with the said space between the outer tube and the inner tube.

17. An arrangement according to claim 15, wherein the outside of the outer tube is provided with surface-enlarging means.

18. An arrangement according to claim 15, wherein the cross-sectional area of the space between the outer and the inner tube is smaller than the cross-sectional area of the inner tube.

19. An arrangement according to claim 15, wherein the inner tube is concentric with the outer tube.

* * * * *